US006289886B1

(12) United States Patent
Radke

(10) Patent No.: US 6,289,886 B1
(45) Date of Patent: Sep. 18, 2001

(54) SIDE TERMINAL FOR DIRECT VENT AND METHOD OF OPERATING SAME

(75) Inventor: George F. Radke, Delta (CA)

(73) Assignee: International Fireplace Products Ltd. (TT)

( * ) Notice: Subject to any disclaimer, the term of this patent is extended or adjusted under 35 U.S.C. 154(b) by 0 days.

(21) Appl. No.: 09/323,434

(22) Filed: Jun. 1, 1999

(51) Int. Cl.[7] ..... F24C 3/00

(52) U.S. Cl. ..... 126/85 B; 126/307 A; 126/312

(58) Field of Search ..... 126/85 B, 299 R, 126/273 A, 307 R; 237/55; 454/243, 43

(56) References Cited

U.S. PATENT DOCUMENTS

| | | | | |
|---|---|---|---|---|
| 424,778 | * | 4/1890 | Gee | 126/85 B |
| 757,348 | * | 4/1904 | Ross | 126/85 B |
| 1,064,592 | * | 6/1913 | Arnold | 126/299 R |
| 2,711,683 | * | 6/1955 | Ryder | 126/85 B |
| 2,755,794 | * | 7/1956 | Wendell | 126/85 B |
| 3,136,309 | * | 6/1964 | Martz | 126/85 B |
| 3,435,816 | * | 4/1969 | De Werth | 126/85 B |
| 3,874,363 | * | 4/1975 | Biedenbender et al. | 126/85 B |
| 3,994,280 | * | 11/1976 | Winters et al. | 126/85 B |
| 4,138,062 | * | 2/1979 | Graden | 126/117 |
| 4,349,009 | * | 9/1982 | Patterson et al. | 126/518 |
| 4,580,548 | * | 4/1986 | Ono | 126/307 A |
| 4,893,608 | * | 1/1990 | Reaser | 126/85 B |
| 5,451,183 | * | 9/1995 | Dahlin | 126/85 B |
| 5,562,088 | * | 10/1996 | Valters et al. | 126/85 B |
| 5,680,856 | * | 10/1997 | Van Dijk | 126/85 B |
| 5,715,808 | * | 2/1998 | Wilhoite | 126/85 B |

OTHER PUBLICATIONS

Price List. Northwest Stoves Ltd. "Simpson Dura–Vent". 2 pages. May/98.

Page P36 of Manual Entitled "Direct Vent Gas Fireplace" dated. Mar./99. Considered to be prior art.

* cited by examiner

*Primary Examiner*—James C. Yeung
(74) *Attorney, Agent, or Firm*—John Russell Uren

(57) ABSTRACT

A side terminal for a direct vent operably connected to the outside wall of a structure within which a fireplace is located. The side terminal is configured such that the exhaust duct carrying combustion gases is located a predetermined distance away from a curved surface. The combustion gases impact the curved surface and are smoothly dissipated along the curved surface to atmosphere thereby reducing back-pressure in the exhaust duct and enhancing combustion efficiency.

17 Claims, 2 Drawing Sheets

SIDE TERMINAL FOR DIRECT VENT AND METHOD OF OPERATING SAME

This invention relates to a side terminal for a direct vent fireplace and, more particularly, to such a side terminal which has increased efficiency in reducing the backpressure within the vent which carries the combustion products from the combustion chamber.

BACKGROUND OF THE INVENTION

The use of direct venting with fireplace inserts and fireplaces generally is well known. Direct venting separates the room air and the combustion air and is differentiated from venting typically known as "B-type" venting. In B-type venting, air obtained from the room is used for combustion. The air then exits the combustion chamber from a vent open directly to the atmosphere. In direct venting, room air is not used from combustion. Rather, air used for combustion is drawn into the combustion chamber by use of a vent which is exposed to the outside ambient air. A first duct connected to the vent conveys this outside air to the combustion chamber. After combustion, this air and the combustion byproducts are conveyed directly to the vent through a second duct which is isolated from the first duct. Typically, the two ducts are cylindrical and concentric with the inlet air being conducted to the combustion chamber through an annulus outside the exit air duct and the exit air being conducted to the vent by way of the inner duct. The room air is drawn from the room within which the fireplace is positioned and is then heated by way of a heat exchanger operably exposed to the combustion chamber. The heated air is returned to the room without direct exposure to the combustion chamber or the air of the combustion chamber. The safety advantages are significant and readily apparent.

Where there is no chimney present such as would usually be the case where the fireplace is located in the basement of a residence, the vent used for fireplace air inlet and air exit is typically located on the outside wall of the house being heated.

There are significant drafts present around the vent located on the wall of the house which affects the backpressure in the exit duct. If there is a good draft present that tends to draw the exit air from the exit duct, the fireplace will operate more efficiently. If there is backpressure present in the exit duct, the draw of inlet air will be reduced which will decrease combustion efficiency and can lead, in poorly designed systems, to extinguishing the combustion flame. This is undesirable.

The prior art vent typically used two flat plates located a distance away from the outlet of the exit duct. The inner flat plate; that is, the plate closest to the exit duct, was impacted by the combustion exhaust products. Because it thereby became heated, a second or outer flat plate of virtually the same dimensions was separated a distance from the first plate to prevent burns. A third plate with a centre hole was provided between the first plate and the outlet of the exhaust duct. The theory behind the use of the third plate is somewhat obscure but the center hole is of a greater diameter than the diameter of the outer inlet air duct and it is known that the use of the third flat plate assists in dissipating the exhaust air coming from the exhaust duct thereby reducing backpressure in the exhaust duct. A rectangular housing was connected on one side to the wall through a wood frame and on the opposite side to four (4) rods which extended through the flat plates. The housing had a series of elongate perforations extending therethrough to protect the inlet duct from negative drafts.

While the prior art side vent generally operates satisfactorily in most applications, the further distance the vent is from the wall of the house, the better the draft will be. The length can be such, in small sized property lots, that the end of the vent may extend over the property line of an adjoining residence. The use of the flat plate upon which the combustion gases impact does not assist in dissipating the exhaust gases and can cause the undesirable backpressure.

SUMMARY OF THE INVENTION

According to one aspect of the invention, there is provided a side terminal for a direct vent fireplace exhausting combustion gases to atmosphere comprising a first air inlet duct and a second exhaust duct, a mounting plate and an outer member connected to said mounting plate, said outer member having a curved inner surface in the area of impact of said combustion gases from said exhaust duct, said curved inner surface being operable to smoothly dissipate said exhaust gases from said area of impact to said atmosphere.

According to a further aspect of the invention, there is provided a method of dissipating exhaust gases from a direct vent fireplace comprising mounting an exhaust duct a predetermined distance from a curved surface and exhausting said exhaust gases from said exhaust duct so as to impact on an area of said curved surface and be smoothly dissipated from said area of impact on said curved surface.

According to yet a further aspect of the invention, there is provided a side terminal for a direct vent fireplace comprising a mounting plate operable to be connected to the wall of a house, a curved member operably connected to said mounting plate, said curved member having a curved inner surface, an air inlet duct connected to a member located a first predetermined distance from said curved inner surface, an exhaust duct concentric to and inside said air inlet duct, said exhaust duct being mounted on said member and likewise being located a second predetermined distance from said curved inner surface, said exhaust duct being operable to discharge exhaust gases onto said curved inner surface.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

Figure 1A:
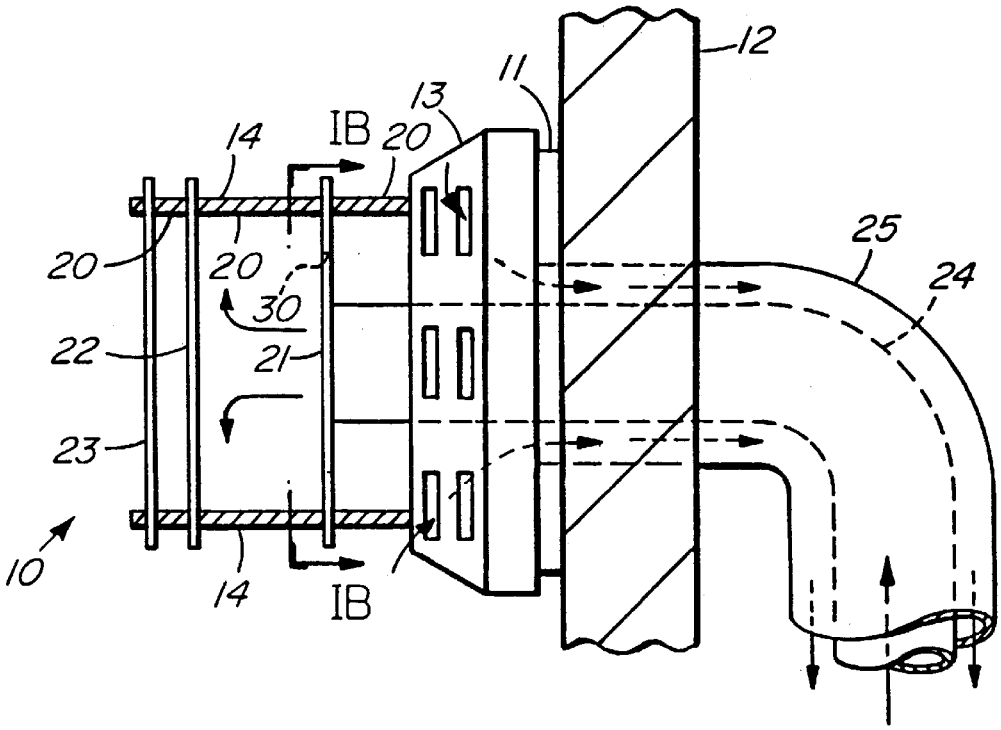
FIG. 1A PRIOR ART
FIG. 1A is a diagrammatic side view of a prior art side terminal for a direct vent which utilises a plurality of flat plates connected to the vent housing.
Figure 1B:
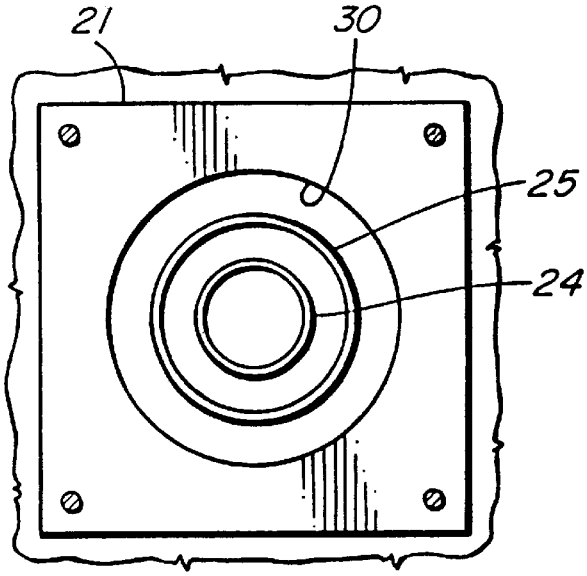
FIG. 1B PRIOR ART
FIG. 1B is a diagrammatic front view of the terminal of FIG. 1A taken along 1B of FIG. 1A.

Referring now to the drawings, a prior art side terminal for a direct vent used for a fireplace within a home is generally illustrated at 10 in FIGS. 1A and 1B. It comprises a generally rectangular wood frame 11 connected to the wall 12 of the house within which the fireplace (not shown) is situated, which frame 11 is connected by screws or otherwise. A housing 13 is connected to the wood frame 11 and four (4) studs 14 are mounted directly to the housing 13 and extend outwardly therefrom. Three (3) spacers 20 are mounted over the studs 14. The length of the three (3) spacers 20 defines the position of three (3) flat plates 21, 22, 23 as will be described. The housing 13 also holds the exhaust and inlet ducts 24, 25, respectively. Inlet duct 25 has a larger diameter than exhaust duct 24 as clearly seen in FIG. 1B. The inlet duct 25 and exhaust 24 are conterminous with the inlet air passing into the combustion chamber of the fireplace through the annulus between the outside diameter of the exhaust duct 24 and the inside diameter of the inlet duct 25.

The first flat plate 22 is a solid rectangular metallic material, conveniently aluminum. The combustion air passing from the exhaust duct 24 impacts the central area of the first flat plate 22. The second plate 23 has virtually the same dimensions as first plate 22. It is located a relatively small distance from first plate 22. Second plate 23 serves a protective function; that is, because first plate 22 will become quite hot because of the impact of combustion gases thereon, second plate 23 will prevent inadvertently contact with first plate 22 thereby for safety considerations. A third plate 21 is located outwardly of the exit of the exhaust duct 24. Third plate 21 has a hole 30 extending therethrough. The hole allows the passage of the exhaust gases therethrough and assists in the dissipation of the exhaust gases following their release from the exhaust duct 24. It will be particularly noted that the combustion gases from the exhaust duct impact plate 22 virtually normal to the flat surface of the plate 22. Such impact creates a backpressure in the exhaust duct 24 which in turn prevents full air inlet through the inlet duct 25 which is disadvantageous because of the adverse affect on fuel combustion.

Figure 2:
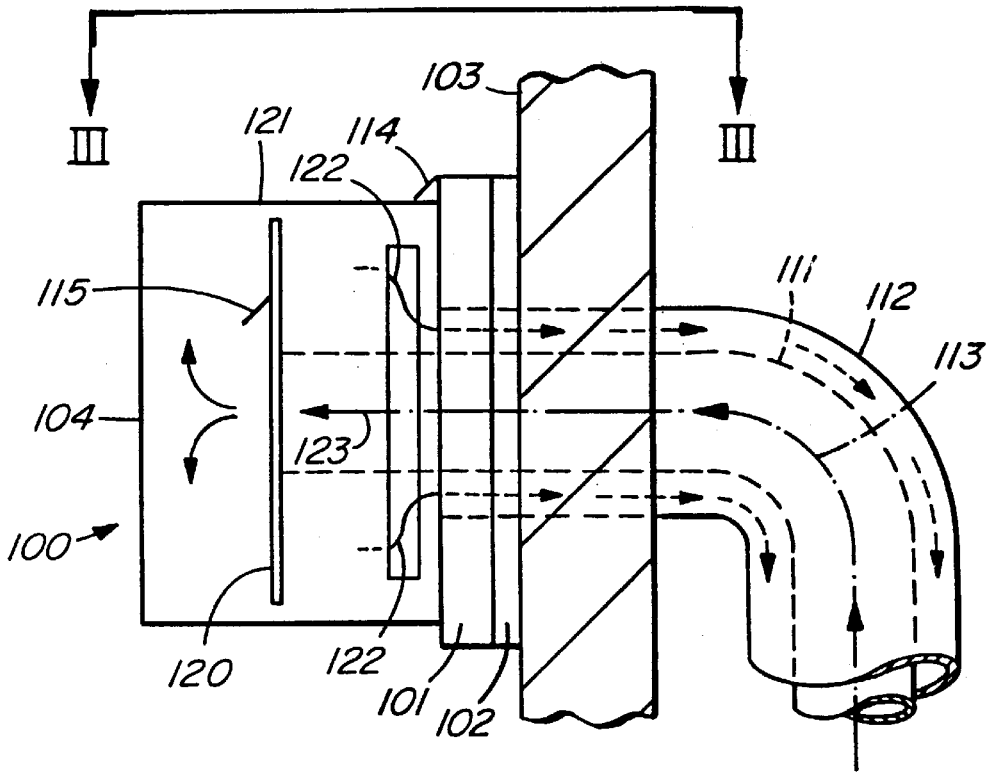
FIG. 2 is a diagrammatic side view of the side terminal for a direct vent according to the present invention.
Figure 3:
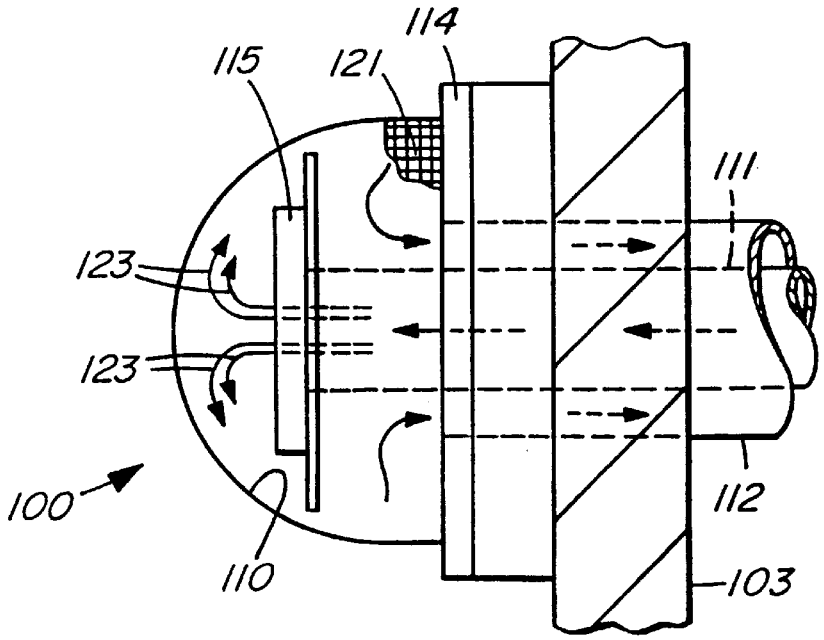
FIG. 3 is a diagrammatic plan view of the side terminal for a direct vent of FIG. 1.

Referring now to FIGS. 2 and 3, the side terminal for the direct vent fireplace according to the present invention is generally illustrated at 100. It comprises a mounting plate 101 which is connected to a wood frame 102 which wood frame 102 is directly connected to outside wall 103 of the house in which the fireplace (not illustrated) is situated. A circular outer cover 104 is connected to the mounting plate 101 as with rivets, welding or the like (not shown). Outer cover 104 has a curved inner surface 110 which, in the embodiment illustrated, is conveniently circular but which could take on other configurations which are curved such as being parabolic shaped and the like.

The exhaust duct 111 is circular in configuration and is located conterminous and within the air inlet duct 112. The exhaust duct 111 and the exhaust duct 112 have a common axis 113 as illustrated in FIG. 2.

A flat plate 120 is connected to the inside of the circular outer cover 104 and extends completely across the circular outer cover 104 as best seen in FIG. 3. Flat plate 104 serves to hold the exit portion of the inlet and exhaust ducts 112, 111, respectively, and maintain them in position relative to the circular outer cover 104.

A first rain cap 114 is connected to the mounting plate 101 and a second rain cap 115 is connected to the flat plate 120. The first and second rain caps 114, 115 serve to deflect rain from the various components which are vulnerable over time to deterioration from water. Screens 121, 124 are mounted to the top and bottom portions of the circular member 104. The screens 121, 122 prevent the ingress of birds and the like from nesting or entering the ducting.

OPERATION

In operation and with reference to FIGS. 2 and 3, inlet air will be drawn into the inlet duct 112 as indicated by the arrows 122 when combustion commences within the fireplace (not shown). Following combustion, the exhaust gases will exit from the terminal from exhaust duct 111 as seen by arrows 123. The exhaust gases will impact on the curved inner surface 110 of the circular outer cover 104 and, because of the smoothly curved surface 110, will be dissipated outwardly from the central core of the exhaust gases which are concentrated at the axis 113 of exhaust duct 111. This smooth dissipation of the exhaust gases to atmosphere reduces the backpressure in the exhaust duct 111 which would otherwise be at an increased value if the curved surface were replaced by a flat plate located normal to the flow of the exhaust gases.

Although the invention has been described in accordance with specific embodiments, many modifications will readily occur to those skilled in the art to which the invention relates and the specific embodiments should be taken as illustrative of the invention only and not as limiting its scope which should defined in accordance with the accompanying claims.

I claim:

1. A side terminal for a direct vent fireplace exhausting combustion gases to atmosphere comprising a first duct being an air inlet duct and a second duct being an exhaust duct, a mounting plate and an outer member connected to said mounting plate, said outer member having an arcuately shaped inner surface in the area of impact of said combustion gases from said exhaust duct, said arcuately shaped inner surface being operable to smoothly dissipate said bottom end portions which are open to said atmosphere, said exhaust gases from said area of impact to said atmosphere, said arcuately shaped inner surface being generated by at least one axis extending generally vertically within said outer member.

2. A side terminal as in claim 1 wherein said outer member is a circular outer member and said curved inner surface is circular in configuration and concentric with said outer member.

3. A side terminal as in claim 2 wherein said exhaust and air inlet ducts are circular, said exhaust and air inlet ducts being concentric, said exhaust duct being within said air inlet duct.

4. A side terminal as in claim 3 wherein said exhaust duct is mounted on a member located a predetermined distance from said curved inner surface.

5. A side terminal as in claim 4 wherein said member is a flat plate extending across said circular outer cover.

6. A side terminal as in claim 5 wherein said exhaust duct is centrally located within said flat plate.

7. A side terminal as in claim 6 and further comprising a screen on said top and bottom end portions of said circular outer cover.

8. A side terminal as in claim 7 and further comprising a first rain cap on the top of said mounting plate.

9. A side terminal as in claim 8 and further comprising a second rain cap mounted on said member.

10. A side terminal as in claim 9 and further comprising an aperture in said circular outer cover adjacent said mounting plate.

11. A side terminal as in claim 10 wherein said aperture is longitudinal and extends vertically in said circular outer cover.

12. Method of dissipating exhaust gases from a direct vent fireplace comprising mounting an exhaust duct a predetermined distance from an arcuately shaped curved surface, and exhausting said exhaust gases from said exhaust duct so as to impact on an area of said arcuately shaped curved surface and be smoothly dissipated from said area of impact on said arcuately shared curved surface, said arcuately shaped curved surface being generated by at least one generally vertically extending axis.

13. Method as in claim 12 wherein said exhaust duct is mounted a predetermined distance from said curved surface by a plate located a predetermined distance from said curved surface.

14. Method as in claim 13 and further comprising allowing air to enter an air inlet duct surrounding said exhaust duct.

15. Method as in claim 14 wherein said air inlet duct is mounted on said member.

16. Side terminal for a direct vent fireplace comprising a mounting plate operable to be connected to the wall of a house, a curved member operably connected to said mounting plate, said curved member having an arcuately shaped curved inner surface, an air inlet duct connected to a member located a first predetermined distance from said arcuately shaped curved inner surface, an exhaust duct concentric to and inside said air inlet duct, said exhaust duct being mounted on said member and likewise being located a second predetermined distance from said aracuately shaped curved inner surface, said exhaust duct being operable to discharge exhaust gases onto said arcuately shaped curved inner surface.

17. Side terminal as in claim 16 wherein said air inlet and exhaust ducts are connected to a plate extending across the inside of said arcuately shaped curved inner surface.

* * * * *